US007728788B1

(12) United States Patent
Echols et al.

(10) Patent No.: US 7,728,788 B1
(45) Date of Patent: Jun. 1, 2010

(54) SEGMENTED REDUNDANT DISPLAY CELL INTERFACE SYSTEM AND METHOD

(75) Inventors: Gregory Frank Echols, Cumming, GA (US); H. Stephen Estes, Roswell, GA (US)

(73) Assignee: International Display Consortium, Alpharetta, GA (US)

( * ) Notice: Subject to any disclaimer, the term of this patent is extended or adjusted under 35 U.S.C. 154(b) by 1253 days.

(21) Appl. No.: 10/963,113

(22) Filed: Oct. 12, 2004

Related U.S. Application Data

(60) Provisional application No. 60/510,847, filed on Oct. 14, 2003.

(51) Int. Cl.
*G09G 5/00* (2006.01)

(52) U.S. Cl. ..... 345/1.3; 345/3.1; 345/103

(58) Field of Classification Search ..... 345/1.1–1.3, 345/102, 103, 903, 2.1
See application file for complete search history.

(56) References Cited

U.S. PATENT DOCUMENTS 6,259,497 B1 * 7/2001 McDonnell et al. ..... 349/73
6,724,382 B2 * 4/2004 Kenyon et al. ..... 345/419
7,019,713 B2 * 3/2006 Hereld et al. ..... 345/1.1
7,136,042 B2 * 11/2006 Magendanz et al. ..... 345/100
7,295,179 B2 * 11/2007 Dunn ..... 345/102
7,561,116 B2 * 7/2009 Westerinen et al. ..... 345/1.1
2003/0020671 A1 * 1/2003 Santoro et al. ..... 345/1.3

* cited by examiner

*Primary Examiner*—Richard Hjerpe
*Assistant Examiner*—Kimnhung Nguyen
(74) *Attorney, Agent, or Firm*—Woodcock Washburn LLP; Barry E. Kaplan

(57) ABSTRACT

A segmented redundant display cell driver interface system and method wherein each of the drivers are totally independent from each other. The system and method provide segmented redundant display cell drive interfaces that drive the display normally in a failure free mode, and that additionally can independently drive a portion of the display in the event of a failure in the drive electronics. With the segmented redundant display cell driver interface, the drive function can be segmented into N independent segments. With N segments, a failure on one of the driver interface boards would cause the loss of 1/Nth of the display, with the remaining display still operational. In the alternative, all the remaining displays could be repositioned by software so that no sub-display information is lost.

18 Claims, 5 Drawing Sheets

Segmented Display Driver Interface

SEGMENTED REDUNDANT DISPLAY CELL INTERFACE SYSTEM AND METHOD

Priority based on U.S. Provisional Patent Application Ser. No. 60/510,847, filed on Oct. 14, 2003, and entitled, "Segmented Redundant Display Cell Interface System" is claimed.

BACKGROUND

I. Field of the Invention

The present invention relates generally to the field displays and display drivers and more particularly to a segmented redundant display cell interface apparatus and system and method.

II. Description of the Related Art

Present display cell driver systems include one or more video sources that are connected to the display cell driver interface, which is connected to the display cell itself. The video signals can be generated by any variety of sources including camera, radar systems, computer display generators and the like. The display cell itself is a display screen including LCDs, plasma screens, LED screens and other optical devices. The display cell driver interface is a circuit that accepts the video signals and generates the proper timing and voltage levels for all the drive signals needed by the display cell in order to display the image. Currently display cells are very fault tolerant in that if there is a display cell failure, only a few pixels, or a line of pixels typically fail. However, a failure on the driver interface circuitry can cause no information to be displayed at all causing a catastrophic single point failure. The current trend in many industries including avionics is toward a single display screen that can display several different smaller screens as sub-displays, displaying information from different video sources, within the one larger screen. Prior to this trend, there would be a single screen for each video source. However, as described above, a single catastrophic failure can cause none of the screens to display.

SUMMARY

The present invention relates to a segmented redundant display cell driver interface design. The present invention uses a segmented display cell driver interface, where each of the drivers are totally independent from each other. Each driver typically receives signals from one video source. The drivers then map the information to appropriate areas of the screen. In the event of one driver failure, only that information from the failed driver is lost and not the information from the other operational drivers. Several video signals or a single video signal can be fed to the redundant driver interface and displayed on the display cell. Software or other reprogramming can adjust the displayed information as needed. More generally, the invention provides segmented redundant display cell drive interfaces that drive the display normally in a failure free mode, and that additionally can independently drive a portion of the display in the event of a failure in the drive electronics. With the segmented redundant display cell driver interface, the drive function can be segmented into N independent segments. With N segments, a failure on one of the driver interface boards would cause the loss of 1/Nth of the display, with the remaining display still operational. As mentioned above, this could result in the loss of only one segmented display. In the alternative, all the remaining displays could be repositioned by software so that no sub-display information is lost.

In general, in one aspect, the invention features a display driver system, including a video source, a segmented display drive cell driver interface connected to the video source and a display cell connected to the driver interface.

In one implementation, the driver interface includes a series of display drivers.

In another implementation, the driver interface includes a plurality of independent and redundantly arranged driver circuits.

In another implementation, each of the plurality of driver circuits each contain all of the video signals In another implementation, each of the plurality of the driver circuits each contain one of the video signals.

In another implementation, the display cell is a plasma display.

In another implementation, the display cell is a LCD display.

In another implementation, the display cell is a LED display.

In another implementation, the display cell is an organic LED display.

In another implementation, the video source is a camera.

In another implementation, the video source is a radar system.

In another implementation, the video source is a computer display generator.

In another implementation, the segmented display drive cell driver interface includes N segments.

In still another implementation, the failure of one segment results in a failure of a portion of the display cell.

In yet another implementation, the remaining N−1 segments continue to display video information to the display cell.

In another implementation, the display cell is adapted to be dynamically reconfigured to display the remaining video information on the operational portion of the display cell.

In another aspect, the invention features a display driver system including a video source, a display cell, means for providing segmented redundant driver cells connected between the video source and the display cell and means for dynamically redisplaying video information on the display cell in the event of a single point failure on the segmented redundant driver cells.

In still another aspect, the invention features a method of displaying video signals on a display cell, including providing a plurality of video signals from one or more video sources, receiving the video signals in a segmented redundant display cell interface having a plurality of redundantly positioned drivers, wherein the video signals are optionally redundantly repeated in each of the drivers, processing the video signals into display cell driver signals, wherein the driver signals optionally include all of the plurality of processed video signals, displaying the processed video signals on the display cell, so that the video signals have a predetermined placement on the display cell and optionally re-displaying the processed video signals on a predetermined portion of the display cell in the event that a portion of at least one of the display cell of driver interface fails.

In still another aspect, the invention features a computer program residing on a computer readable medium comprising instructions for causing a computer to direct a video source to provide a plurality of video signals from one or more video sources, instruct a segmented redundant display cell interface having a plurality of redundantly positioned drivers to receive the video signals, wherein the video signals are optionally redundantly repeated in each of the drivers, process the video signals into display cell driver signals, wherein the driver signals optionally include all of the plurality of processed video signals, display the processed video signals on the display cell, so that the video signals have a predetermined placement on the display cell and optionally re-display the processed video signals on a predetermined portion of the display cell in the event that a portion of at least one of the display cell of driver interface fails.

One advantage of the invention is that it provides segmented redundant display cell drivers so that various source of video information can be provided on a single screen.

Another advantage of the invention is that it provides degraded modes of operation and partial display operation without the need for completely redundant displays.

Another advantage of the invention is that the display cell itself (in many forms including plasma, LCD, LED, organic LED and the like) lends itself to degraded modes of operation rather than catastrophic failures.

Another advantage of the invention is that a cost savings is realized by displaying information on a single large display rather than several smaller displays.

Another advantage of the invention is that the single display cane be dynamically reprogrammed.

Other objects, advantages and capabilities of the invention will become apparent from the following description taken in conjunction with the accompanying drawings showing the preferred embodiment of the invention.

DETAILED DESCRIPTION

The embodiments described herein provide for large screen displays to support critical information display without the threat of a single point failure disabling the entire display. Typically, degraded mode of operation continues in the event of a failure. A segmented redundant system allows for a portion of the display to continue to operate in the event of a failure. Therefore, critical operations can continue until the display can be replaced or repaired. Consistent with modern trends toward a single display screen that can display several different smaller screens as sub-displays, displaying information from different video sources, within the one larger screen, the embodiments described herein display information on a single screen with the added feature of fault tolerance. For example, instead of five separate instruments each with their own displays, the trend is to instead use one large smart display on which all the information from the five replaced displays can be presented, all under re-programmable software. The embodiments described herein prevent the problem that if the driver for the one larger display fails then a significant amount of information is lost.

The display cell itself (in many forms including plasma, LCD, LED, organic LED and the like) lends itself to degraded modes of operation rather than a completely inoperative single screen resulting from catastrophic failures. If there is a problem with the display cell itself, it is typically limited to a single circuit element failure resulting in the failure of 1 dot out of one million or possibly one line out of one thousand. Typically, the main focus of failure is the circuit board in the driver that contains the display cell drive interface electronics. Such a failure of the board results in no portion of the screen being operational. The embodiments solve the single point of failure problem with the display cell driver organized in a segmented redundant manner thereby allowing degraded modes of operation instead of total failure, dynamic re-programmability of the display, typically through software and a significantly higher reliability of the display as needed in many critical applications. Since larger screens take up more physical space, it is undesirable to add more screens for redundancy. By including the segmented redundant driver, less space is used in place of additional screens.

Figure 1:
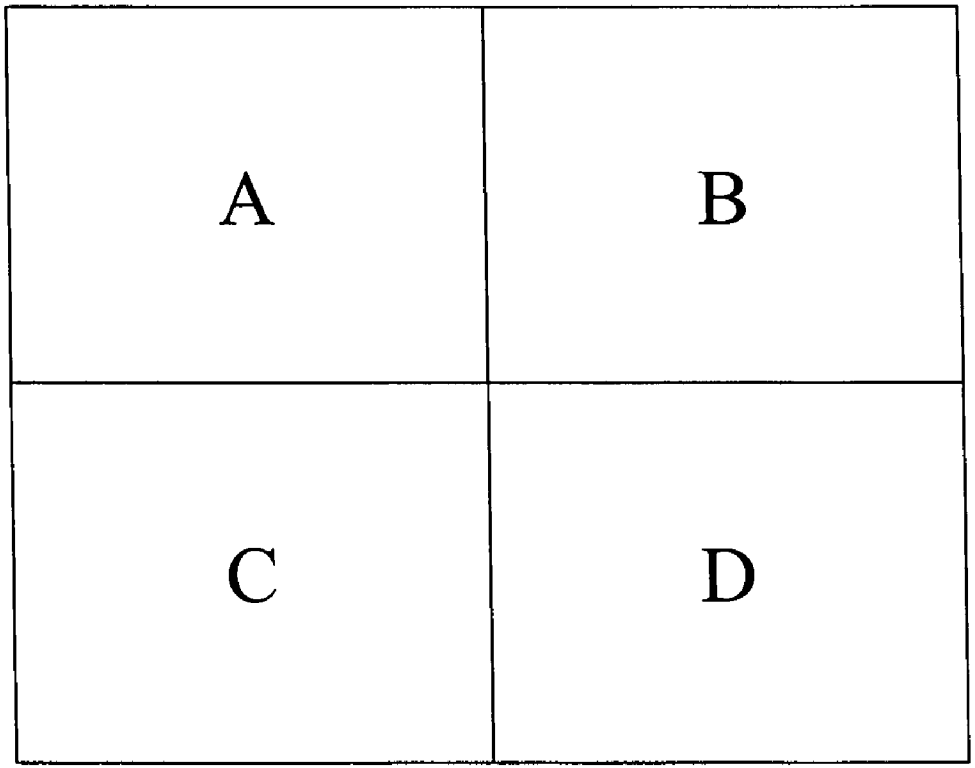
FIG. 1 illustrates an embodiment of a display screen displaying four sources of information.
Figure 2:
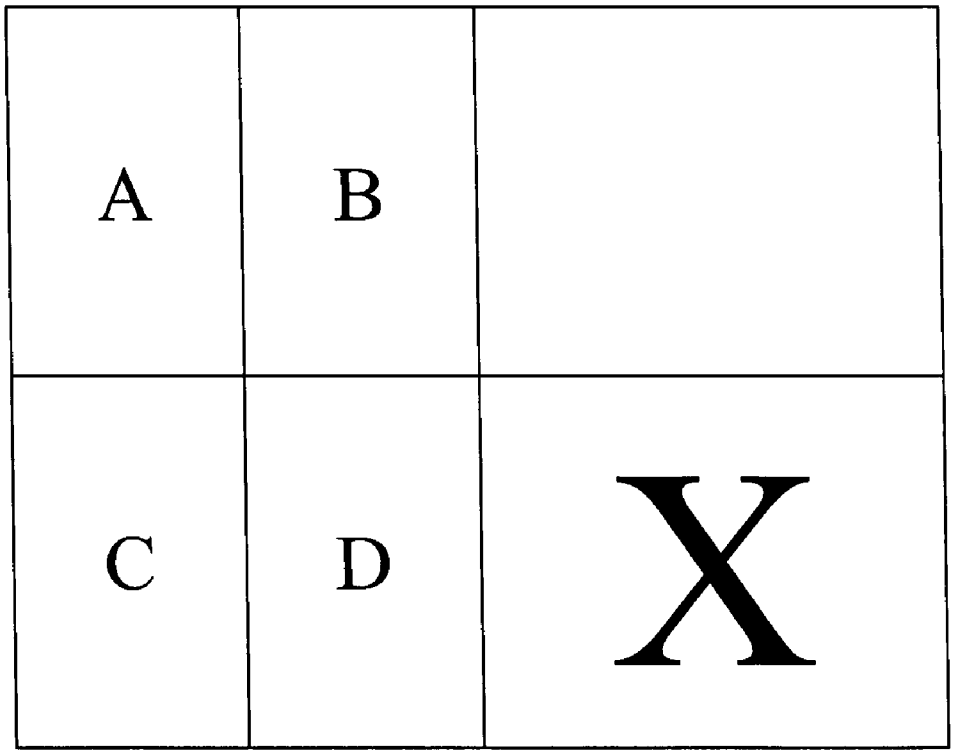
FIG. 2 illustrates the display screen as in FIG. 1 with the four sources of information mapped to a different portion of the display.

The segmented redundant display drive interfaces the display normally in a failure free modes and additionally independently drive a portion of the display in the event of failure in the drive electronics. With the segmented redundant display cell driver interface, the drive function can be segmented into N dependent segments. With N segments, a failure on one of the driver interface boards causes the loss of 1/Nth if the display, with the remaining display still operational. For example, when the traditional drive circuitry approach is replaced with the segmented redundant display cell drive using four redundant segments, and a failure occurs on one of the segments, then ½ of the display is still usable. FIG. 1 illustrates an embodiment of a display screen displaying four sources of information. In this example, different sources of information are displayed as A, B, C and D. In the event of the failure of the driver for D, the drivers for A, B and C would still be operational and display the information provided on A, B and C. This example assumes that each of the drivers A, B, C and D are dedicated for the display portions A, B, C and D. Therefore, if the driver for D fails, then the information for D is lost, which may be critical information. In another embodiment, each of the four redundant drivers contain information for A, B, C and D. Therefore, even if one of the drivers fails, then A, B, C and D are still displayed. But since one of the driver failed, a portion of the display cell may be in a failed mode. Software can then be used to map the four pieces of information to a smaller part of the cell that is still operational. FIG. 2 illustrates the display screen as in FIG. 1 with the sources of information A, B, C and D mapped to a different portion of the display. In this way, the failed portion of the screen originally mapped for D in FIG. 1, having failed, has no information mapped to it. Thus, in order to retain the continuity of the display pattern, the portion of the screen originally mapped for B as shown in FIG. 1 is no longer displayed and only ½ of the screen is used, that is the portion originally used to map and display A and C as shown in FIG. 1. Therefore, the ½ of the screen is used to map and display the entirety of A, B, C and D. Therefore, no information is lost due to a single driver failure. It is further understood that any if there are any additional failures, the information A, B, C, and D can be mapped to any of the remaining portions of the screen, in this case having been divided into quadrants. It is understood that other embodiments contemplate any number of divisions of the screen with a corresponding redundant driver.

Figure 3:
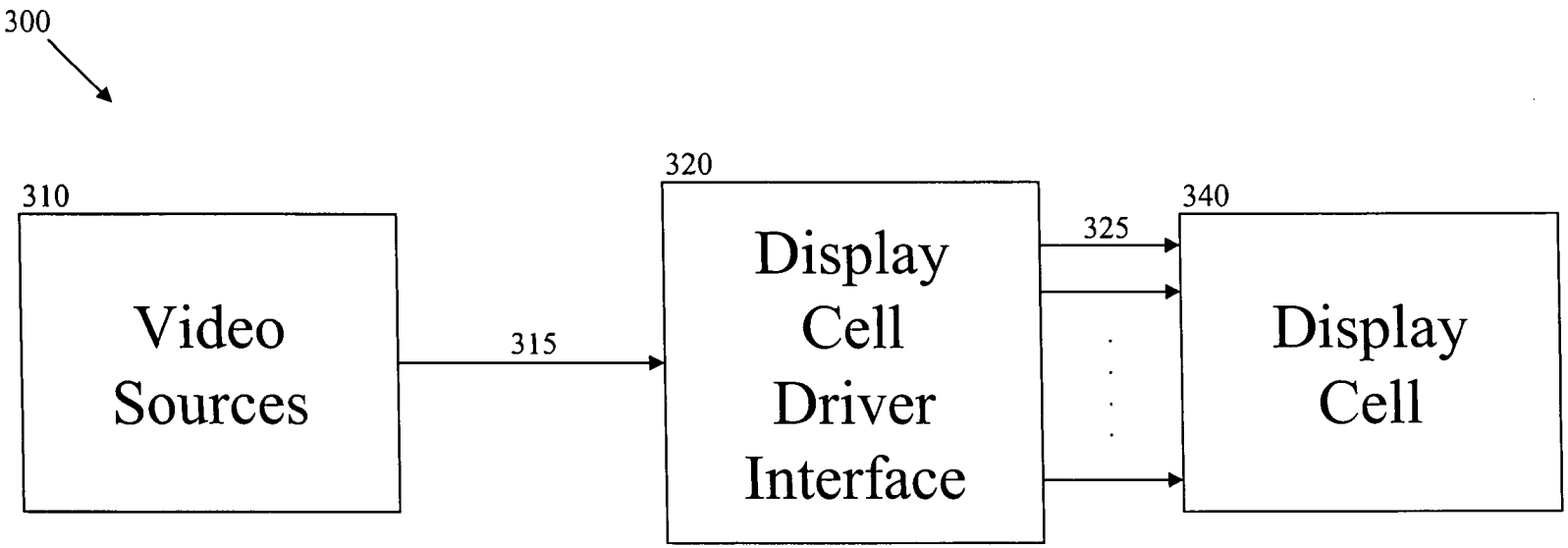
FIG. 3 illustrates a diagram of an embodiment of a driver circuit functional implementation.

FIG. 3 illustrates a diagram of an embodiment of a driver circuit functional implementation 300 that is typically utilized in display driver interface implementations. In a typical implementation, there are sources of video signals 315 to be displayed for the information presentation to an operator from a video source 310. The video sources 310 could be generated from a camera, radar system, computer display generator and the like. It is understood that the embodiments described herein contemplate a variety of other video sources.

Some form of visual display device 340 is utilized to provide the video image to the user in some monochrome, black and white or color image. The display cell device 340 can be a number of different devices including but not limited to LCD, plasma, LED, organic LED or any other optical device.

In order for the informational image from the video source 310 to be presented on the display cell device 340, the video signal 315 must be transformed by a display cell driver interface circuit card 320 that accepts the video signal 315 from the video source 310 and generates the proper timing, voltage levels and other parameters for all the drive signals 325 needed by the display cell device 340 in order to display the image.

Since typically available technologies for display cell devices are inherently fault tolerant, normal failure modes of the display cell device do not cause a complete failure of the device, but instead cause a degradation in the image such as the loss of a single pixel of a single line (either horizontally or vertically). Failures on the display cell driver interface that causes no information to be displayed on the display cell and hence results in a catastrophic single point failure is avoided by adding additional drive interfaces resulting in the segmented redundant display cell system.

Figure 4:
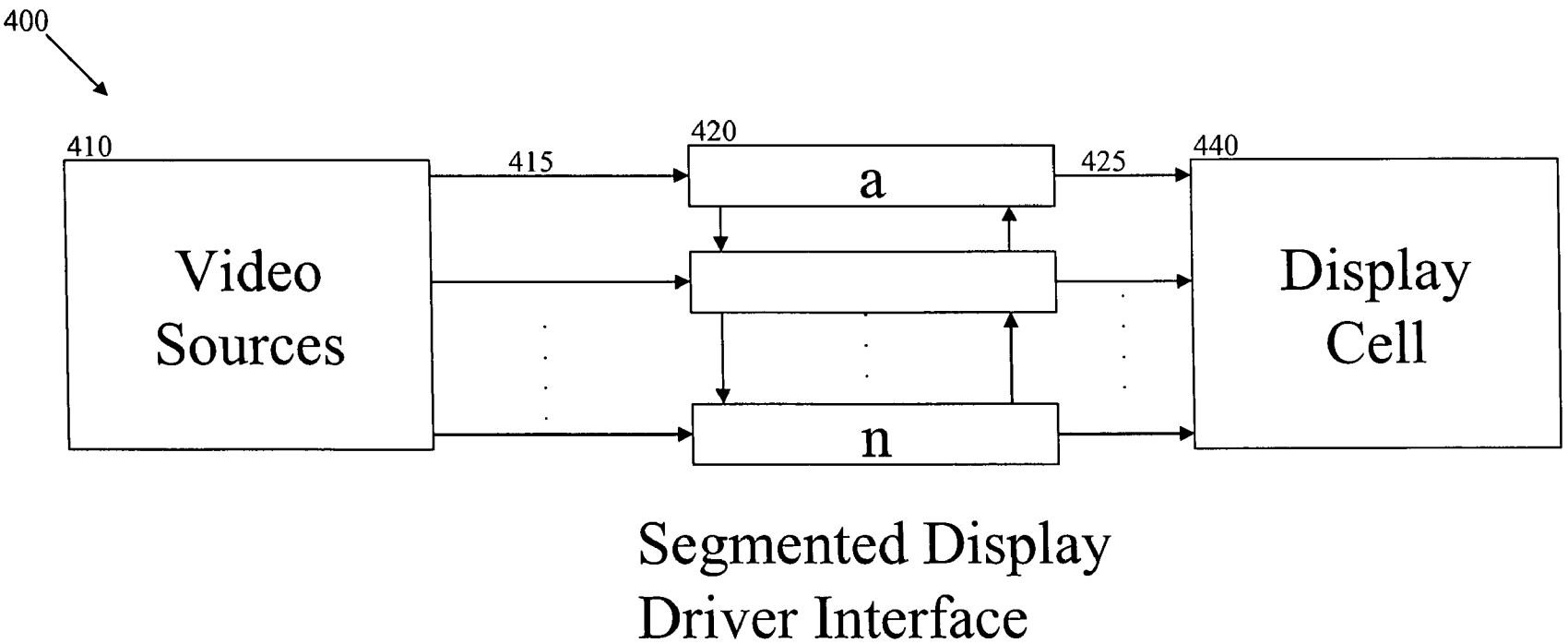
FIG. 4 illustrates a top level, functional diagram of an embodiment of a segmented redundant display cell interface system.

FIG. 4 illustrates a top level, functional diagram of an embodiment of a segmented redundant display cell interface system 400. The video sources 410 and the display cell 440 are similar to the implementation described in FIG. 3. The video output 415 from the video source 410 can still be a single source or to make maximum use of the segmented redundant display cell driver interface system 420, multiple video signals 415 can be provided.

In the segmented redundant display driver cell interface system 420, the segmented drivers a-n are totally independent from each other, each taking care of providing the respective video driver signal 425 to a portion of the display cell 440 by generating the appropriate timing and voltage signals for a portion of the display 440. In an example, this could be ½ of the display if the interface is segmented into 2 redundant segments, ¼ of the display if the interface is segmented into four redundant segments, etc. During normal, failure free modes of operation, the segmented interface 420 functions identically to the traditional implementation, providing the video imagery from the video source 410 as separate signals 415 to the display cell 440 in a manner in which the display cell 440 can generate an optical image.

In the event of a failure, however, of any of the components on the segmented redundant display driver interface system 420 or the entire failure of one of the redundant drivers a-n, the segment that has the failure no longer is able to properly provide timing and voltage signals to the portion of the display cell 440 connected to the failed segment, causing failure of only that portion of the display 440. The remainder of the display is still provided the appropriate timing, voltage signals and other parameters from the independent display cell driver interface segments a-n, allowing the remaining portion of the display 440 to continue to function. As described above, each segment a-n can be dedicated to a single video source 410 of information. In the event of a single failure, only that dedicated piece of information is lost. In another embodiment, each of the segments a-n can contain or have access to each of the video sources 410 so that in the event of a single failure, the remaining segments a-n (minus the failed segment) pick up the information that is lost to that portion of the display 440 and dynamically redisplays all of the information on the display 440 so that no one piece of information is lost at all. In a typical implementation, this dynamic redisplay is performed in software.

Figure 5:
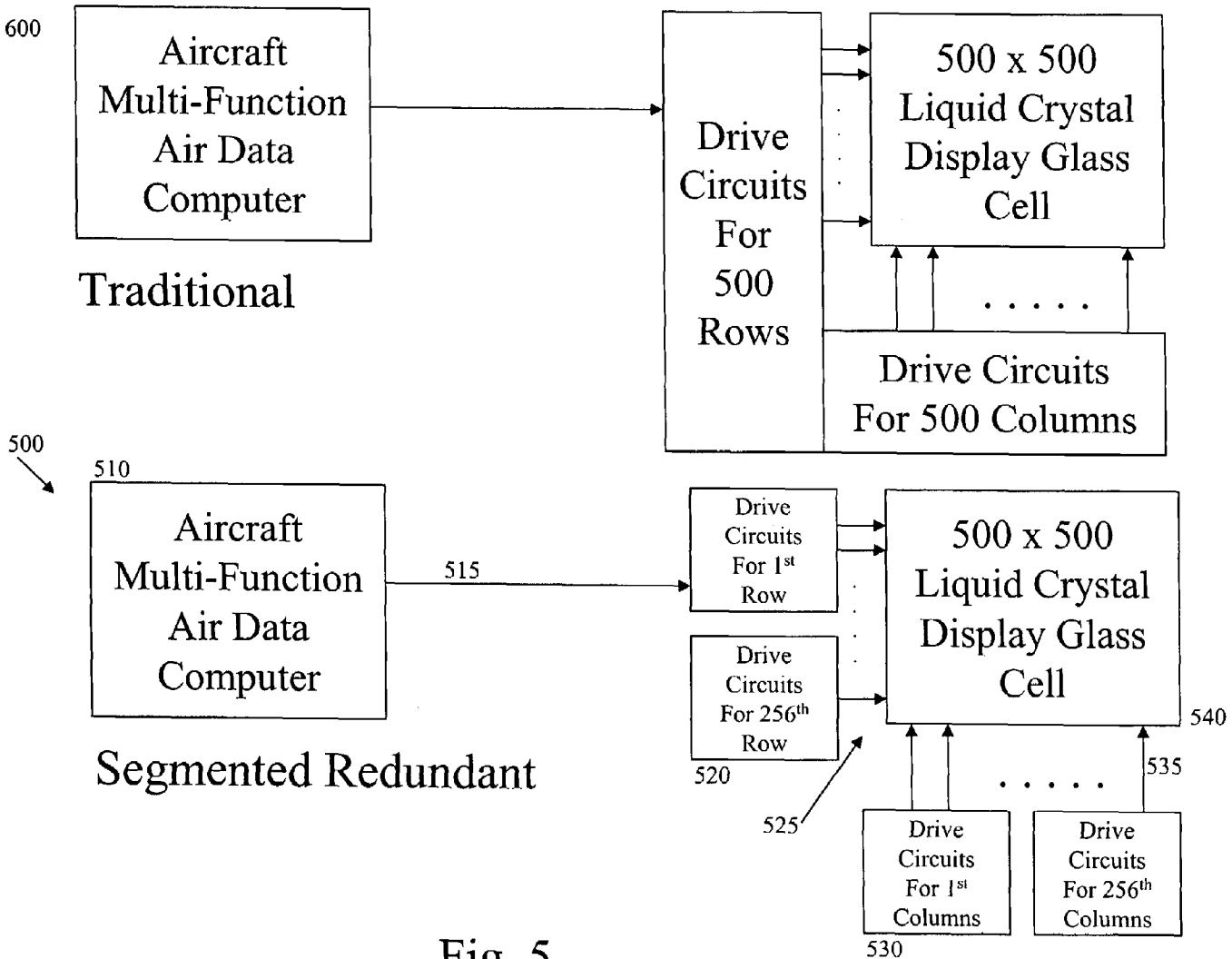
FIG. 5 illustrates an embodiment of a segmented redundant display cell interface system.

FIG. 5 illustrates an embodiment of a segmented redundant display cell interface system 500. A traditional display system 600 is further illustrated to show the improvement as shown in the embodiment of the system 500. This figure illustrates an example of one type of implementation on the row column driver interface for an LCD display panel. The video sources 510 and the display cell 540 are similar to the implementations described above. The video output 515 from the video source 510 can still be a single source or to make maximum use of the segmented redundant display cell driver interface system 520, 530, multiple video signals 515 can be provided.

In the embodiment described, redundant interface systems are up for both a row interface system 520 and a column interface system 530 to further maximize the use of redundancy. In the segmented redundant display driver cell interface system 520, the segmented drivers 1-256 are totally independent from each other, each taking care of providing the respective video driver signal 525 to the row portion of the display cell 540 by generating the appropriate timing and voltage signals for that portion of the display 540. Similarly, in the segmented redundant display driver cell interface system 530, the segmented drivers 1-256 are totally independent from each other, each taking care of providing the respective video driver signal 535 to the row portion of the display cell 540 by generating the appropriate timing and voltage signals for that portion of the display 540. During normal, failure free modes of operation, the segmented interfaces 520, 530 functions identically to the traditional implementation, providing the video imagery from the video source 510 as separate signals 515 to the display cell 540 in a manner in which the display cell 540 can generate an optical image.

In the event of a failure, however, of any of the components on the segmented redundant display driver interface systems 520, 530 or the entire failure of one of the redundant drivers 1-256, for either the rows or columns, the segment that has the failure no longer is able to properly provide timing and voltage signals to the portion of the display cell 540 connected to the failed segment, causing failure of only that portion of the display 540. The remainder of the display is still provided the appropriate timing, voltage signals and other parameters from the independent display cell driver interface segments 1-256, for either the rows or columns, allowing the remaining portion of the display 540 to continue to function. As described above, each group of row or column segments 1-256 can be dedicated to a single video source 510 of information. In the event of a single failure, only that dedicated piece of information is lost. In another embodiment, each of the segments a-n can contain or have access to each of the video sources 510 so that in the event of a single failure, the remaining segments 1-256 (minus the failed segment) pick up the information that is lost to that portion of the display 540 and dynamically redisplays all of the information on the display 540 so that no one piece of information is lost at all. In a typical implementation, this dynamic redisplay is performed in software. It is understood that other embodiments are not limited to the row/column driver interface LCD interface example.

The software techniques and methods discussed above can be implemented in digital electronic circuitry, or in computer hardware, firmware (as discussed), software, or in combinations of them. Apparatus may be implemented in a computer program product tangibly embodied in a machine-readable storage device for execution by a programmable processor;

and methods may be performed by a programmable processor executing a program of instructions to perform functions by operating on input data and generating output. Further embodiments may advantageously be implemented in one or more computer programs that are executable on a programmable system including at least one programmable processor coupled to receive data and instructions from, and transmit data and instructions, to a data storage system, at least one input device, and at least one output device. Each computer program may be implemented in a high level procedural or object-oriented programming language, or in assembly or machine language, which can be compiled or interpreted. Suitable processors include, by way of example, both general and special purpose microprocessors. generally, a processor receives instructions and data from read-only memory and or RAM. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing may be supplemented by, or incorporated in, specially designed application specific integrated circuits (ASICs).

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A display driver system, comprising:

a video source having a plurality of video signals;

a segmented display drive cell driver interface connected to the video source;

a display cell connected to the driver interface, the display cell having independently mapped images from the driver interface, wherein each said mapped image is independently driven by said segmented display drive cell driver interface; and means for dynamically redisplaying the mapped images on the display cell in the event of a single point failure on the segmented driver interface, wherein the segmented display drive cell driver interface dynamically remaps the images to revised areas of the display cell to display the video information to the display cell area mapped to the failed driver cell and to all mapped areas of the display.

2. The system as claimed in claim 1 wherein the driver interface includes a series of display drivers.

3. The system as claimed in claim 2 wherein the driver interface includes a plurality of independent and redundantly arranged driver circuits.

4. The system as claimed in claim 3 wherein each of the plurality of driver circuits each contain all of the video signals.

5. The system as claimed in claim 3 wherein each of the plurality of the driver circuits each contain one of the video signals.

6. The system as claimed in claim 1 wherein the display cell is a plasma display.

7. The system as claimed in claim 1 wherein the display cell is a LCD display.

8. The system as claimed in claim 1 wherein the display cell is a LED display.

9. The system as claimed in claim 1 wherein the display cell is an organic LED display.

10. The system as claimed in claim 1 wherein the video source is a camera.

11. The system as claimed in claim 1 wherein the video source is a radar system.

12. The system as claimed in claim 1 wherein the video source is a computer display generator.

13. The system as claimed in claim 1 wherein the segmented display drive cell driver interface includes N segments.

14. The system as claimed in claim 13 wherein the failure of one segment results in a failure of only a portion of the display cell.

15. The system as claimed in claim 14 wherein the remaining N−1 segments continue to display video information to the display cell.

16. The system as claimed in claim 15 wherein the display cell is adapted to be dynamically reconfigured to display the remaining video information on the operational portion of the display cell, irrespective of similarities or differences of the plurality of video signals and irrespective of similarities or differences in content of said plurality of video signals.

17. A display driver system comprising:

a single video source;

a display cell;

means for providing segmented redundant driver cells connected between the video source and the display cell, said segmented redundant driver cells independently mapping information from the video source to respective mapped areas of the display cell to display video information; and means for dynamically redisplaying video information on the display cell in the event of a single point failure on the segmented redundant driver cells, wherein the functional segmented redundant driver cells dynamically remap to revised areas of the display cell to display the video information to the display cell area mapped to the failed driver cell and to all mapped areas of the display.

18. A method of displaying video signals on a display cell, comprising:

providing a plurality of video signals from one or more video sources;

receiving the video signals in a segmented redundant display cell interface having a plurality of redundantly positioned drivers, wherein the video signals are optionally redundantly repeated in each of the drivers;

processing the video signals into display cell driver signals, wherein the driver signals optionally include all of the plurality of processed video signals;

displaying the processed video signals on the display cell, so that the video signals have a first predetermined placement on the display cell; and optionally re-displaying the processed video signals on a second predetermined portion of the display cell in the event that a portion of at least one of the display cell of driver interface fails, such that no portion of the display cell is without display and such that all of the video signals from the one or more video sources are displayed.

* * * * *